US006422892B1

(12) United States Patent
Chen et al.

(10) Patent No.: US 6,422,892 B1
(45) Date of Patent: Jul. 23, 2002

(54) SCSI CABLE PLUG RETAINING SEAT

(75) Inventors: Jui-Hung Chen, Taipei; Hsien-Chien Li; Chi-Wen Chen, both of Sanchung, all of (TW)

(73) Assignee: Comtrend Corporation, Taipei Hsien (TW)

( * ) Notice: Subject to any disclaimer, the term of this patent is extended or adjusted under 35 U.S.C. 154(b) by 0 days.

(21) Appl. No.: 09/878,298

(22) Filed: Jun. 12, 2001

(51) Int. Cl.[7] ..... H01R 13/64
(52) U.S. Cl. ..... 439/378
(58) Field of Search ..... 439/378, 362, 439/247, 248

(56) References Cited

U.S. PATENT DOCUMENTS 4,980,800 A * 12/1990 Furuta ..... 361/391
5,252,089 A * 10/1993 Hatagishi et al. ..... 439/310
5,385,481 A * 1/1995 Kotyuk ..... 439/378
5,391,091 A * 2/1995 Nations ..... 439/378
5,486,116 A * 1/1996 Meiler et al. ..... 439/347
5,622,511 A * 4/1997 Jarrett ..... 439/248
5,690,504 A * 11/1997 Scanlan et al. ..... 439/378
5,795,177 A * 8/1998 Hirono ..... 439/378
6,074,235 A * 6/2000 Brandberg et al. ..... 439/378
6,146,210 A * 11/2000 Cha et al. ..... 439/680
6,227,897 B1 * 8/2001 D'Agostino ..... 439/362

* cited by examiner

*Primary Examiner*—Tho D. Ta
*Assistant Examiner*—Phuongchi Nguyen
(74) *Attorney, Agent, or Firm*—Rosenberg, Klein & Lee

(57) ABSTRACT

A SCSI cable plug retaining seat includes two guide holes, two guide pins, and a seat. The two guide holes are combined to the upper and lower grooves of the cable plug. The two guide pins are installed to a channel unit connector. The seat has an L shape and the bottom thereof having an opening and has two screws and two screw holes. The retaining base of the present invention serves to fix the cable plug by the screw, and then is locked to the rear covering plate of the shelf. When the channel unit slides into the shelf through card guide, the channel unit connector will be guided into the guide holes by the guide pins so that the channel unit connector is precisely combined to the cable plug. Therefore, the connector can be pulled and inserted rapidly.

3 Claims, 3 Drawing Sheets

SCSI CABLE PLUG RETAINING SEAT

FIELD OF THE INVENTION

The present invention relates to a SCSI cable plug retaining seat, and especially to SCSI cable plug to be fixed to a shelf through retaining base, and therefore, when a channel unit is inserted or pulled out in the shelf, the screws on the cable plug is unnecessary to be detached.

BACKGROUND OF THE INVENTION

In the prior art SCSI cable plug, the channel unit is inserted to the shelf through a card guide, and then the connector of the channel unit exposes to the groove of the rear covering plate in the shelf so that the cable plug is directly combined to the connector on the channel unit. Then the screws aside the cable plug is used to fix the two. However, this way has the following disadvantages.

1. As it is desired to draw out the channel unit, the screw fixed to the cable plug behind the shelf must be detached.
2. When the cable plug is detached from the connector of the channel unit, the cable plug can not be fixed and thus must be placed anywhere. If it is necessary to reconnect the channel unit with the cable plug, the polarities, positions and order must be rearranged. The efficiency is low.

Therefore, the aforesaid prior art has many defects necessary to the improved.

SUMMARY OF THE INVENTION

Accordingly, the primary object of the present invention is to provide a SCSI cable plug retaining seat, wherein as the channel unit in the shelf is to be updated, the channel unit can be pulled out or inserted into directly without needing to release the screws, and thus the operation is convenient and time is saved.

Another object of the present invention is to provide a SCSI cable plug retaining seat, wherein guide holes and guide pins are used to combine the male and female connectors.

To achieve the object, the present invention provides A SCSI cable plug retaining seat comprising:

a seat having an L shape and the bottom thereof having an opening; two ears at an upper side of the seat having screw holes; the screw holes being positioned with respect to the screw holes of the cable plug; a screw being used to combine the seat with the cable plug; two ends of the seat being installed with fixing screws; fixing screws being used to lock the seat with cable plug to the rear covering plate on the shelf;

two guide holes being clamping between the grooves of the upper and lower casings of the cable plug and being inserted by the guide pins of the channel unit connector to be positioned therein; and two guide pins being installed on the channel unit connector; the guide pins being inserted into the guide holes in the cable plug so that the channel unit connector is tightly combined with the cable plug on the seat of the channel unit connector.

The various objects and advantages of the present invention will be more readily understood from the following detailed description when read in conjunction with the appended drawing.

DETAILED DESCRIPTION OF THE PREFERRED EMBODIMENTS

Figure 1:
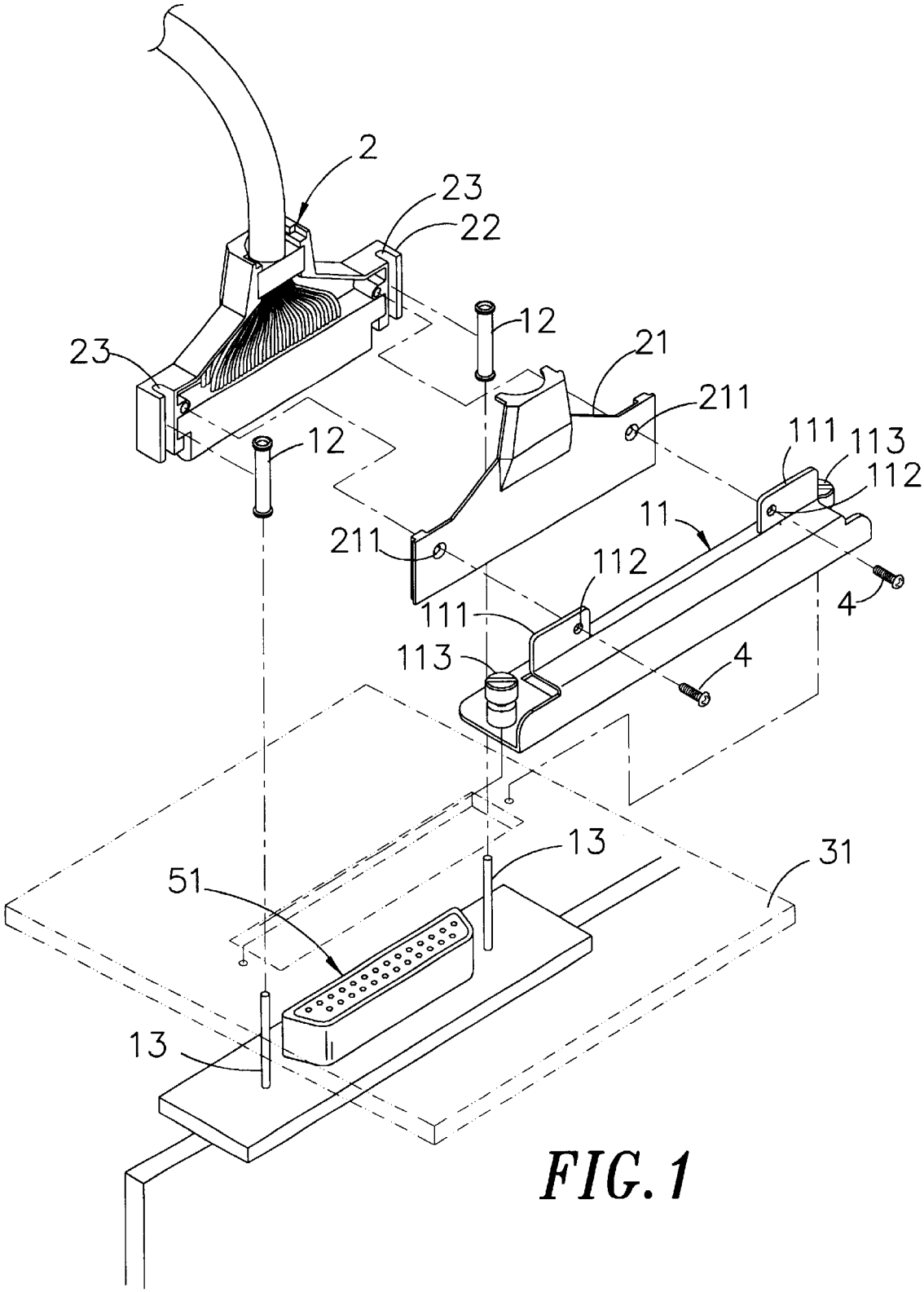
FIG. 1 is an exploded view of the SCSI cable plug retaining seat in the present invention.

Referring to FIG. 1, exploded view of the SCSI cable plug retaining seat according to the present invention is illustrated. From the drawings, it is appreciated that the present invention includes the following components:

A seat 11 has an L shape and the bottom thereof has an opening. The two ears 111 have screw holes 112. The screw holes 112 are at positions with respect to the screw holes 211 of the cable plug 2. Then screw 4 is used to combine the seat 11 with the cable plug 2. Two ends of the seat 11 are installed with fixing screws 113. The fixing screws 113 are used to lock the seat 11 with cable plug 2 to the rear covering plate 31 on the shelf 3.

Two guide holes 12 are clamping between the grooves 23 of the upper and lower casings 21, 22 of the cable plug 2 and are inserted by the guide pins 13 of the channel unit connector 51 to be positioned therein.

Two guide pins 13 are installed on the channel unit connector 51. The guide pins can be inserted into the guide holes 12 in the cable plug 2 so that the channel unit connector 51 is tightly combined with the cable plug 2 on the seat 11 of the channel unit connector 51.

Figure 2:
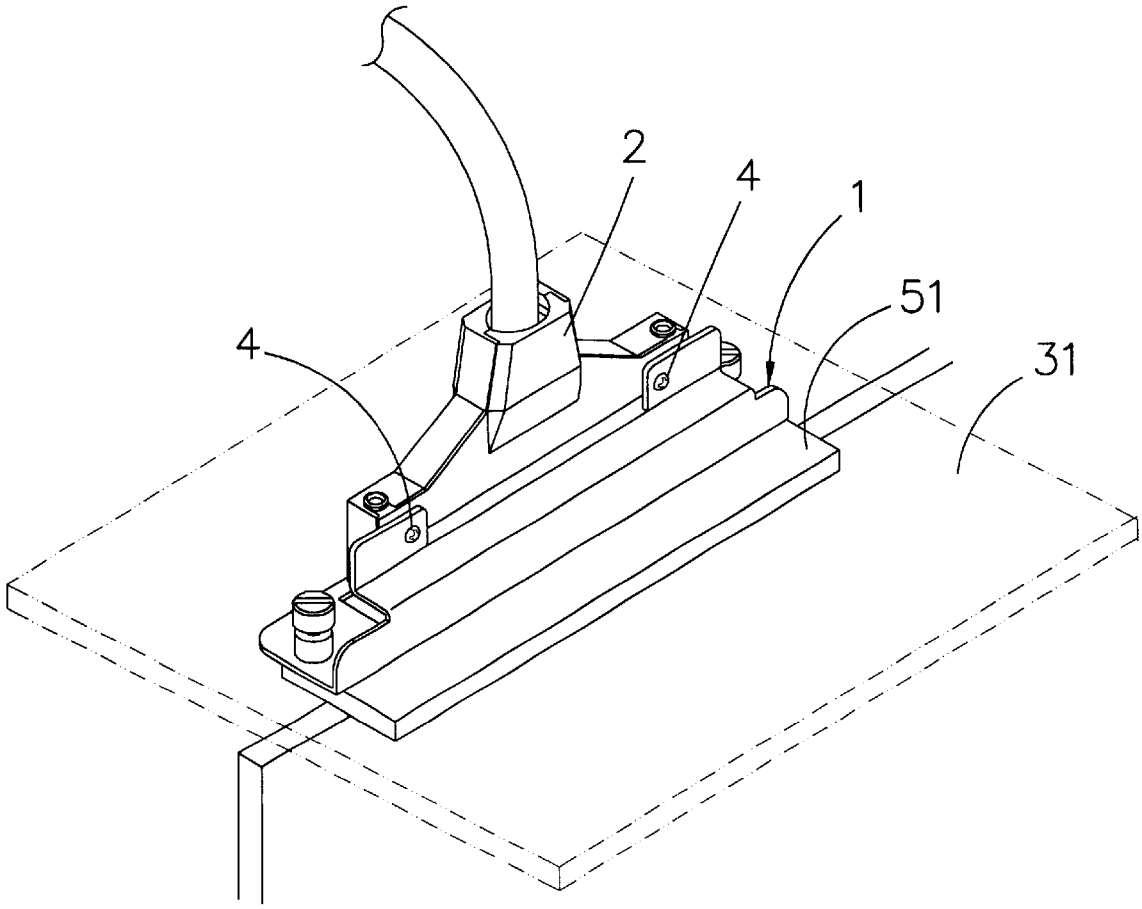
FIG. 2 is perspective view of the SCSI cable plug retaining seat in the present invention.

Referring to FIG. 2, a perspective view of the SCSI cable plug retaining seat according to the present invention is illustrated. The retaining base of the present invention serves to fix the cable plug 2 by the screw 4, and then is locked to the rear covering plate 31 of the shelf 3. Then, the guide pins aside the channel unit connector 51 will pass through the guide holes 12 of the cable plug 2 so that the channel unit connector 51 is precisely combined with the cable plug 2.

Figure 3:
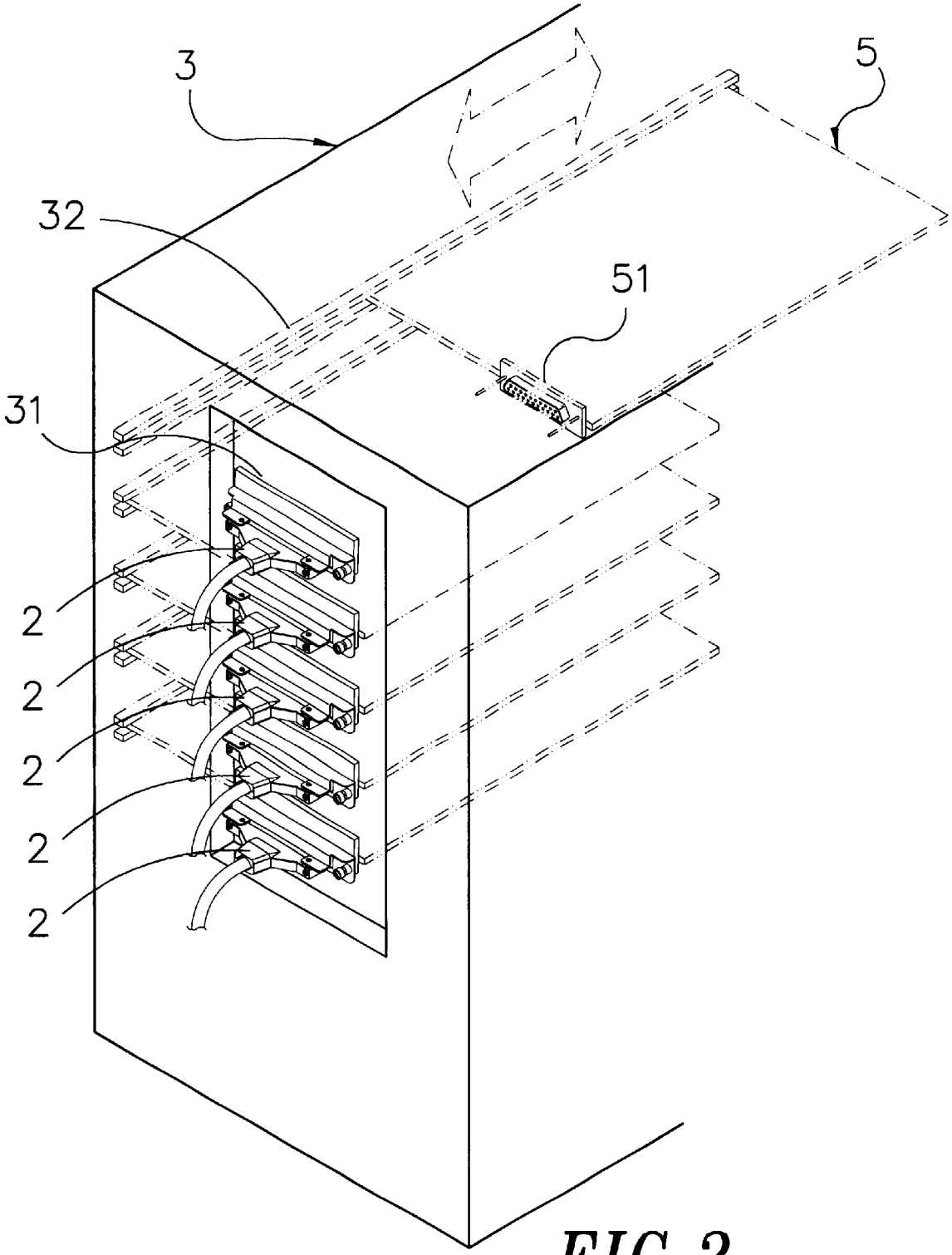
FIG. 3 is a schematic view of the SCSI cable plug retaining seat.

Referring to FIG. 3, a schematic view of the SCSI cable plug retaining seat of the present invention is illustrated. In the present invention, a plurality of cable plugs 2 can be fixed to the rear covering plate 31 of the channel unit connector 51. When the channel unit 5 slides into the shelf 3 through card guide 32, the channel unit connector 51 will be guided into the guide holes by the guide pins so that the channel unit connector 51 may be precisely combined to the cable plug 2. When the user desires to take out the channel unit 5 from the shelf 3, it is only necessary to extract the channel unit 5 directly.

The SCSI cable plug retaining seat of the present invention has the following advantages as comparing with the prior art.

1. In the SCSI cable plug retaining seat of the present invention, as the channel unit in the shelf is to be changed, the channel unit can be pulled out or inserted into directly without needing to release the screws, and thus the operation is convenient and time is saved.
2. In the SCSI cable plug retaining seat of the present invention, guide holes and guide pins are used to combine the male and female connectors.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A SCSI cable plug retaining seat comprising:

an L-shaped seating bracket having an upper section and a lower section, said L-shaped seating bracket including (a) an opening in said lower section, (b) two fixing screws, each of said fixing screws being positioned at a corresponding end of said lower section, locking said SCSI cable plug retaining seat to a rear covering plate of an equipment shelf, and (c) two ears extending from said upper section, said ears each having a screw hole formed therethrough;

a cable plug casing having an upper casing section and a lower casing section and enclosing a cable plug therein, said cable plug casing having two screw holes respectively formed in opposing ends of said cable plug casing, said screw holes being respectively disposed in alignment with said screw holes of said L-shaped seating bracket, said screw holes being positioned so that a pair of screws may be respectively passed through said screw holes of said L-shaped seating bracket and into said screw holes of said cable plug casing to mechanically affix said L-shaped seating bracket to said cable plug casing, said upper casing section, having two grooves respectively formed in opposing ends of said upper casing section, said lower casing section having two grooves respectively formed in opposing ends of said lower casing section, said grooves in said lower casing section being respectively positioned in aligned relationship with said grooves of said upper casing section;

two tubular guide holes, each of said tubular guide holes being mounted in a corresponding one of said grooves of said upper casing section and retained therein by a corresponding one of said grooves of said lower casing section; and a channel unit connector mounted to a channel unit and having two laterally projecting guide pins mounted thereon, each of said guide pins being located in aligned relationship with a corresponding one of said tubular guide holes when said channel unit connector is conjoined with said cable plug, wherein the channel unit having said channel unit connector mounted thereon is inserted into a card guide in said equipment shelf, said channel unit connector being precisely aligned with said cable plug by means of said guide pins being passed into said tubular guide holes, said channel unit being removable from the equipment shelf without manually disconnecting said cable plug therefrom.

2. The SCSI cable plug retaining seat of claim 1, wherein said cable plug is a male connector.

3. The SCSI cable plug retaining seat of claim 1, wherein said cable plug is a female connector.

* * * * *